US005682077A

United States Patent [19]

Hanssen et al.

[11] Patent Number: 5,682,077

[45] Date of Patent: Oct. 28, 1997

[54] DISPLAY DEVICE AND CATHODE RAY TUBE

[75] Inventors: Peterus H. C. Hanssen; Martinus A. M. Van Den Heuvel; Johannes M. G. Verhoeven; Henry A. Schweitz; Adrianus L. G. Van Den Eeden, all of Eindhoven, Netherlands

[73] Assignee: U.S. Philips Corporation, New York, N.Y.

[21] Appl. No.: 650,207

[22] Filed: May 20, 1996

Related U.S. Application Data

[63] Continuation of Ser. No. 213,770, Mar. 16, 1994, abandoned.

[30] Foreign Application Priority Data

Mar. 17, 1993 [BE] Belgium ..... 09300250

[51] Int. Cl.[6] ..... H01J 31/00

[52] U.S. Cl. ..... 313/478; 313/477 R; 348/749

[58] Field of Search ..... 313/478, 477 R; 348/748, 749; 264/261

[56] References Cited

U.S. PATENT DOCUMENTS

| | | | |
|---|---|---|---|
| 2,342,778 | 2/1944 | Wolff | 250/238 |
| 4,155,102 | 5/1979 | Bongenaar | 348/824 |
| 4,191,725 | 3/1980 | Armstrong et al. | 264/261 |
| 4,405,949 | 9/1983 | Hockenbrock et al. | 348/749 |
| 4,543,510 | 9/1985 | Chiba et al. | 313/477 R |
| 4,568,852 | 2/1986 | Kobayashi et al. | 313/36 |
| 4,599,535 | 7/1986 | Toch | 313/478 |
| 4,617,490 | 10/1986 | Fitzpatrick et al. | 313/478 |
| 4,631,594 | 12/1986 | Imabayashi et al. | 348/781 |
| 4,645,966 | 2/1987 | van Esdonk | 313/24 |
| 4,665,336 | 5/1987 | Howden | 313/36 |
| 4,717,853 | 1/1988 | Ezawa et al. | 313/35 |
| 4,780,640 | 10/1988 | Hasegawa | 313/36 |
| 4,982,286 | 1/1991 | Mitani et al. | 348/559 |
| 4,982,289 | 1/1991 | Mitani et al. | 348/749 |
| 5,084,225 | 1/1992 | Ishigaki et al. | 264/261 |
| 5,241,393 | 8/1993 | Maresca | 348/822 |

FOREIGN PATENT DOCUMENTS 4016590 11/1991 Germany .

OTHER PUBLICATIONS

Webster's II New Riverside University Dictionary p. 567.

*Primary Examiner*—Mark R. Powell
*Assistant Examiner*—Lawrence O. Richardson
*Attorney, Agent, or Firm*—Robert J. Kraus; Arthur G. Schaier

[57] ABSTRACT

A display device comprising a cathode ray tube is provided with a holder which comprises a faceplate and which is arranged in front of the display window. The space between the faceplate and the display window is filled with a liquid or a gel. An improved image display, in particular an improved contrast and a flatter image are obtained.

28 Claims, 4 Drawing Sheets

DISPLAY DEVICE AND CATHODE RAY TUBE

Figure 1:
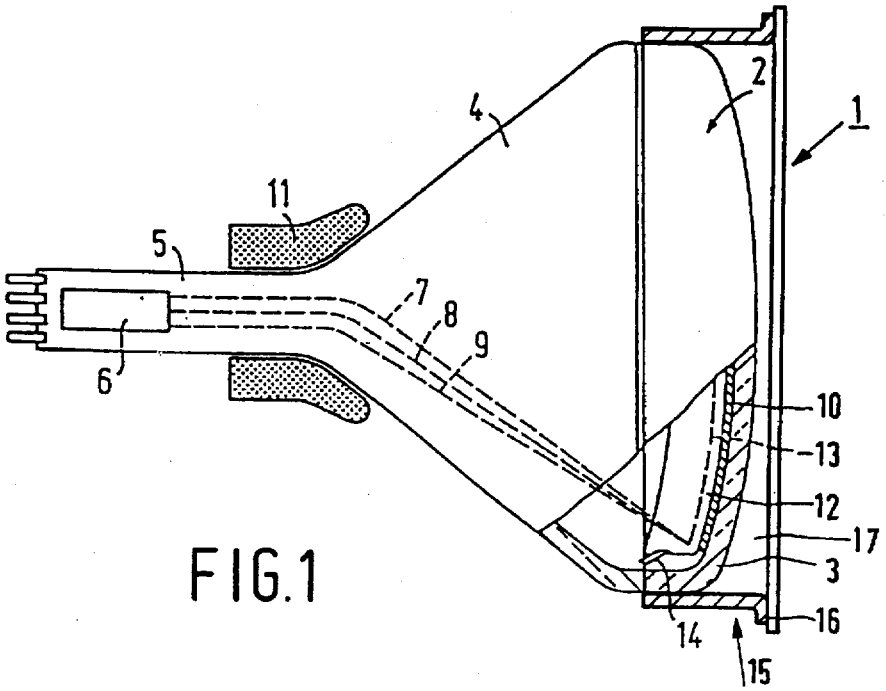

This is a continuation of application Ser. No. 08/213,770, filed Mar. 16, 1994, now abandoned.

The invention relates to a direct-vision display device comprising a cathode ray tube having a display window.

BACKGROUND OF THE INVENTION

Such display devices are commercially available.

A display device of this type generally comprises, in an evacuated envelope, a means for generating at least one electron beam (hereinafter referred to as "electron gun") and a display window whose inner surface facing the electron gun is provided with a luminescent screen. An image can be displayed on the luminescent screen by deflecting the at least one electron beam by means of deflection means (for example a system of deflection plates or coils) across the luminescent screen. The display window also has an outer surface through which a viewer can see the image displayed on the luminescent screen. However, the viewer also sees imperfections on the outer surface. These imperfections may be in the form of scratches, indentations etc. and may be caused by the manner in which the cathode ray tube has been manufactured. The viewer also sees reflections at the outer surface. All of these effects adversely affect the quality of the image displayed. Measures to avoid such disturbing effects are generally costly and give rise to other problems. The provision of, for example, an anti-reflection filter leads to a reduced reflection, but is time-consuming, costly and does not always eliminate the adverse effect of scratches etc., besides, it often has the disadvantage that the filter itself can become corroded, damaged or partially detached. In case the filter does not work properly, it is very difficult to remove.

SUMMARY OF THE INVENTION

It is an object of the invention to provide a display device of the type mentioned in the opening paragraph, in which the above drawback is reduced in a simple manner.

To this end, the display device in accordance with the invention is characterized in that a holder which is provided with a transparent plate is arranged in front of the display window, and a transparent liquid having a refractive index which deviates maximally 0.25 from the refractive indices of the display window and the plate is provided in the space between the display window and the plate.

Imperfections on the display window as well as reflections at the display window are made invisible to a substantial degree by the liquid. The liquid almost perfectly follows the surface of the display window (as well as the surface of the faceplate). By virtue of the small difference in refractive index between the display window and the liquid almost no reflections occur at the interface between the display window and the liquid. In general, the same is true of the interface between the plate and the liquid. In general, ageing or discoloration of liquids hardly occurs, if at all, nor can such liquids dry out or shrink or become detached from the display window or the plate. In addition, the invention has the advantage that it is applicable to any type of cathode ray tube-display device. A liquid can readily be removed from the holder and, if necessary, replaced by another liquid. In other words, the measure taken to alleviate the drawbacks can, if necessary, be reversed or repeated in a simple manner. A further advantage is that the outer surface of the display window does not require an accurate aftertreatment. This simplifies the method of manufacturing the cathode ray tube.

In an alternative embodiment of the invention, the holder contains a gel instead of a liquid. In comparison with a solid substance, a gel has some of the abovementioned advantages of a liquid. A gel, like a liquid, follows the outer surface of the display window and, in general, does not dry out. The disadvantage of a gel relative to a liquid is, however, that there is a relatively big risk that, on filling the space, bubbles will form in the gel which are visible. A gel is not a hard solid substance and, hence, can be removed relatively easily. The advantage of a gel over a liquid is that the risk of leakage is smaller.

An embodiment of the invention in which the cathode ray tube comprises an implosion-protection band around the display window is characterized in that the holder is secured to the implosion-protection band. The holder can be more readily secured to the implosion-protection band than to the display window.

An embodiment of the invention in which the cathode ray tube comprises an implosion-protection band around the display window is characterized in that the implosion-protection band, viewed in a direction transversely to the display window, is extended in the direction of the plate, so that a portion of the implosion-protection band forms part of the holder.

This simplifies the manner in which the display window is made and reduces the number of components required as well as the manufacturing time.

In a further embodiment, the side faces of the holder are opaque. This leads to a higher contrast of the image displayed.

In a further embodiment, the plate is flat. The plate may be slightly curved. However, preferably the plate is flat, because the image displayed is then perceived as being very flat. A substantially flat plate hardly exhibits disturbing reflections and can be manufactured and treated in a simple manner.

Besides, if a (substantially) flat plate is used, the image displayed appears to be much flatter.

In a further embodiment, the plate is provided with an antireflection filter on the outside. This suppresses the reflection at the plate.

The invention also relates to a cathode ray tube for use in a display device.

BRIEF DESCRIPTION OF THE DRAWING FIGURES

Figure 2A:
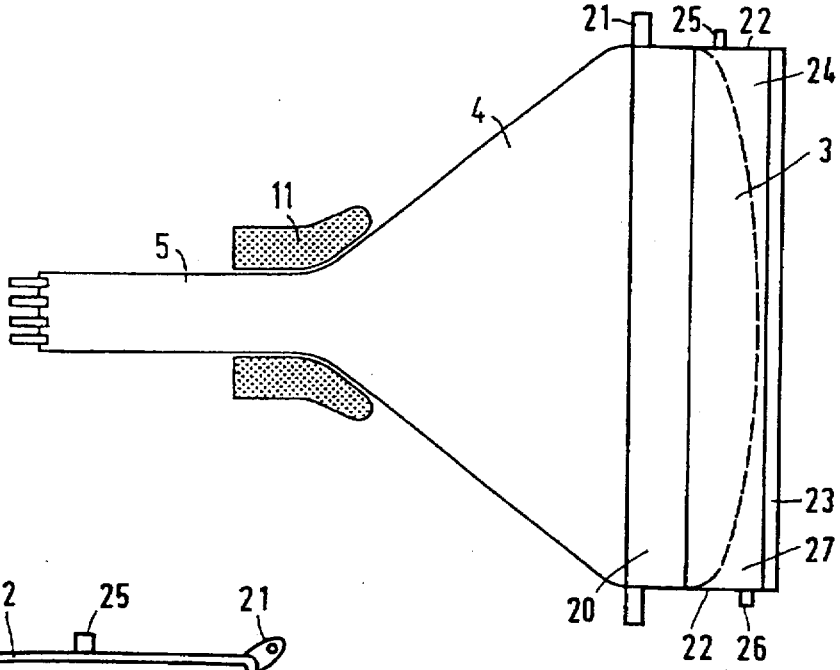
Figure 2B:
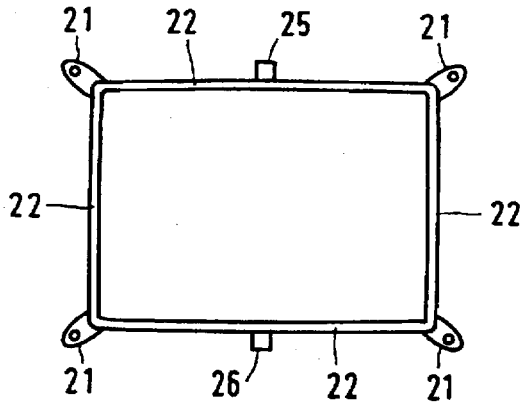
Figure 3:
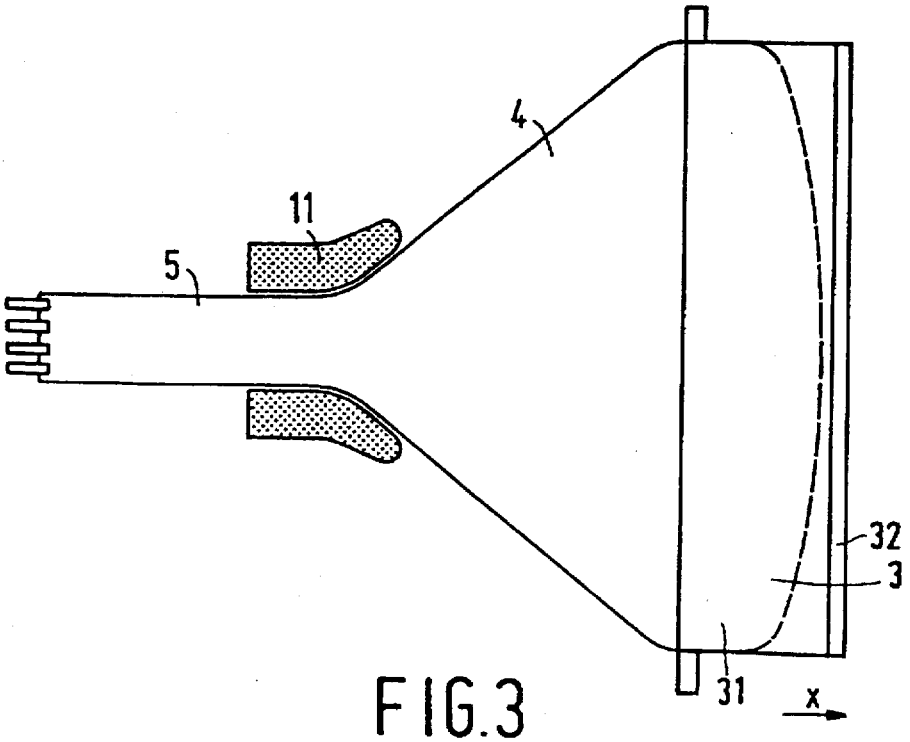
Figure 4A:
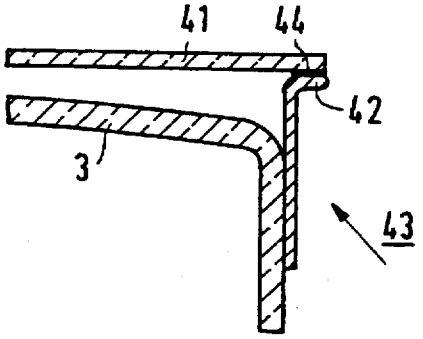
Figure 4B:
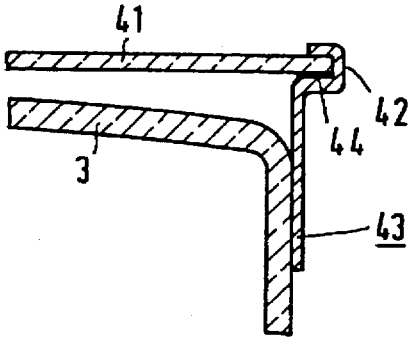
Figure 4C:
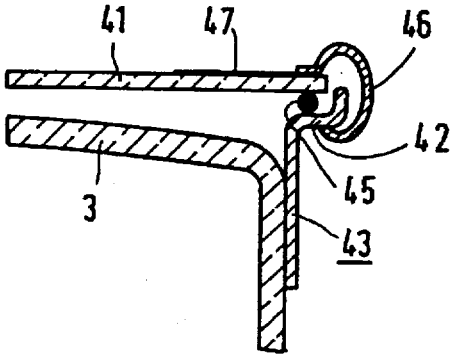
Figure 5A:
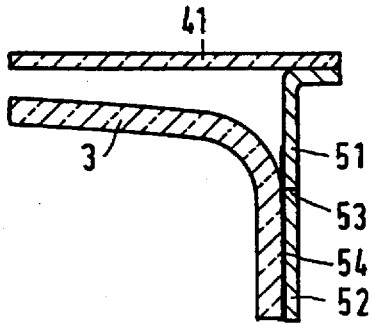
Figure 5B:
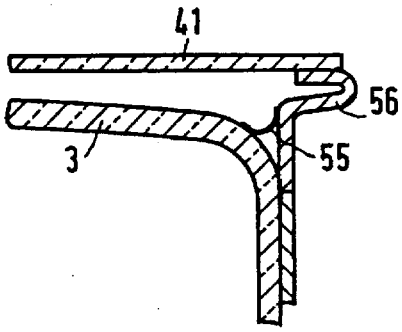
Figure 5C:
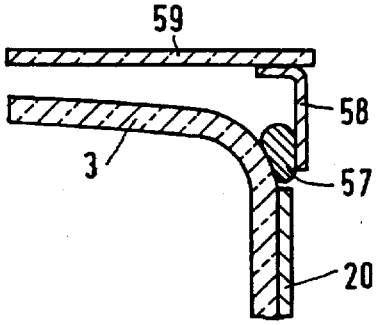
Figure 5D:
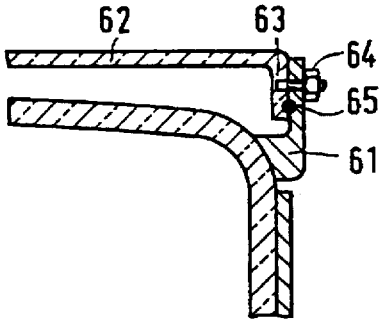
Figure 5E:
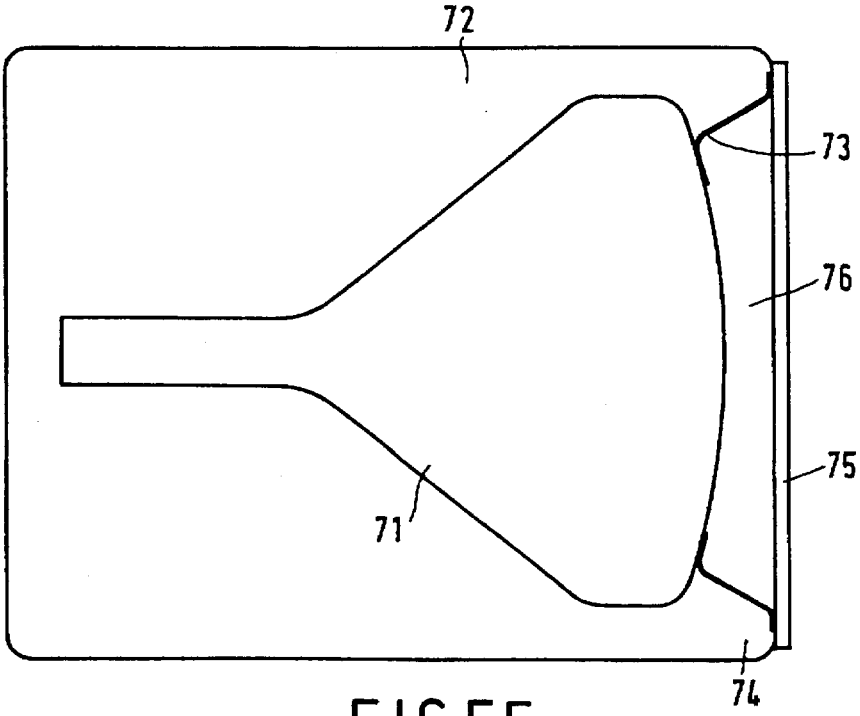
Figure 6A:
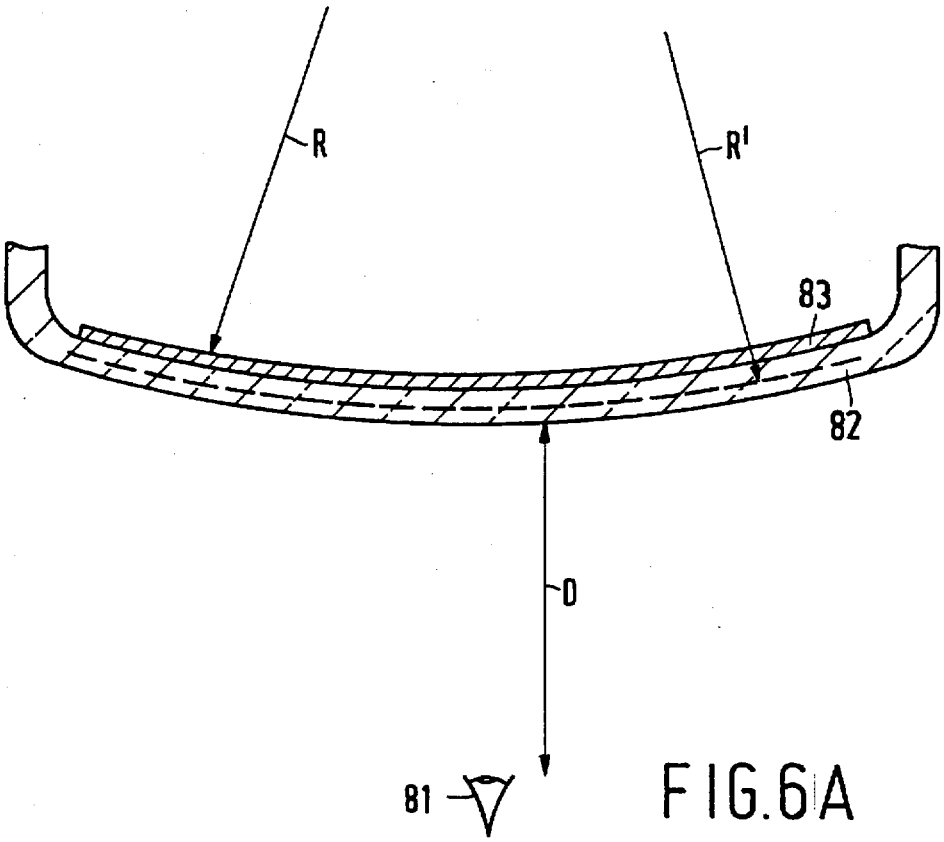
Figure 6B:
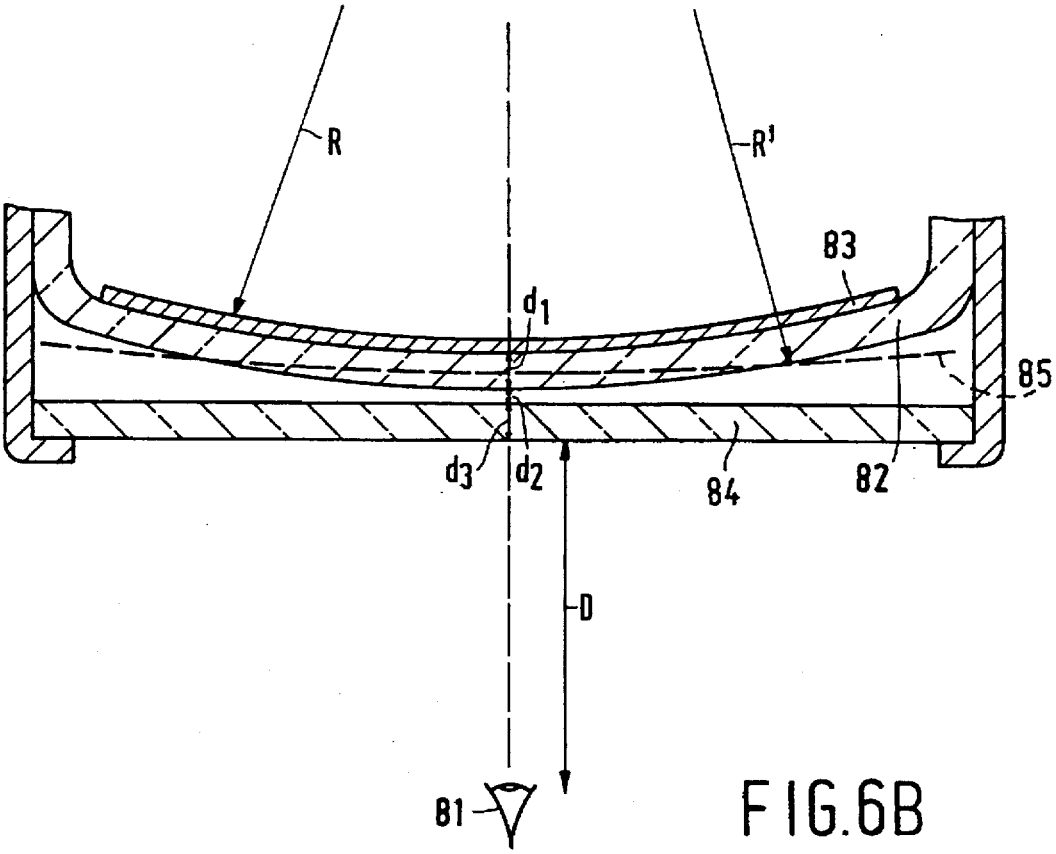

These and other aspects of the invention will be described hereinbelow with reference to the accompanying drawing, in which FIG. 1 shows a display device in accordance with the invention;

FIGS. 2*a* and 2*b* are detailed representations of a display device with a holder;

FIG. 3 shows a further embodiment of a cathode ray tube in accordance with the invention;

FIGS. 4*a*, 4*b* and 4*c* show a detail of embodiments of the invention;

FIGS. 5*a*, 5*b*, 5*c*, 5*d* and 5*e* show a detail of embodiments of the invention; and FIGS. 6*a* and 6*b* illustrate an effect of the invention.

DESCRIPTION OF THE INVENTION

FIG. 1 is a partly perspective view of a cathode ray tube-display device in accordance with the invention. The display device has a cathode ray tube 1 which comprises an evacuated envelope 2 having a display window 3, a cone 4 and a neck 5. In the neck there is provided an electron gun 6 for generating, in this example, three electron beams 7, 8 and 9. On the inner surface of the display window 3 there is provided a luminescent screen 10 which, in this example, comprises phosphor elements luminescing in red, green and blue. On their way to the screen 10, the electron beams 7, 8 and 9 are deflected across the screen 10 by means of a deflection unit 11 which is arranged at the interface between the neck and the cone with the electron beams passing through a shadow mask 12 comprising a thin plate having apertures 13. The electron beams 7, 8 and 9 pass through the apertures 13 at a small angle and each electron beam impinges on phosphor elements of only one colour. The shadow mask is suspended in a display tube by means of suspension means 14. The problem to be solved by the present invention is that the outer surface of the display window may adversely affect the picture quality. The display window may readily become scratched during the transport of the display window or in the manufacture of the display tube. Background light which is reflected at the outside is also disturbing. This problem is preferably solved in a simple manner which is not subject to the effects of ageing, which can preferably also be applied to existing tubes and which is preferably reversible and repeatable in a simple manner. To this end, a holder 15 is placed in front of the display window. The holder comprises, in this example, a flat plate 16. The space between the flat plate 15 and the outer surface of the display window 3 is filled with a liquid 17 whose refractive index corresponds substantially to the refractive indices of the display window and the plate. "Corresponds substantially" is to be understood to mean herein that the difference is less than 0.25. The liquid contacts the outer surface of the display window and perfectly follows said surface even if said surface is not completely clean. By virtue thereof, imperfections on the surface, such as scratches etc., become invisible. Owing to the small difference in refractive index, the reflection at the interface between the display window and the liquid is small, namely less than 25% of the normal reflection. Preferably, the difference in refractive index is less than 0.1. In this case, the reflection is less than 4% of the normal reflection. The construction is relatively simple. In general the liquid is not subject to ageing and, in particular, cannot dry out. Thus, ageing effects occur hardly, if at all. The construction can also be used on existing tubes. The liquid is removable and replaceable.

If a solid substance (for example cement or glue) is provided in the space between the display window and the plate, this substance must properly cover and adhere to the display window. Otherwise, scratches on the display window or plate and, even more importantly, the interface between the display window and the solid substance are clearly visible. Even if the solid substance is provided so as to properly cover the display window, corrosion, thermal stresses and/or drying out and/or hardening may cause the interface or cracks in the solid substance to become visible in certain areas of the display window with the passage of time. Replacing the solid substance is very difficult.

In this example, the outer surface of the display window is formed by the material, for example glass, of the display window, i.e. the display window is not provided with a coating. This is a preferred embodiment. In an advantageous embodiment of the invention, the outer surface of the display window is not treated. Following the manufacture of the display window, its outer surface is customarily treated to remove irregularities. This treatment may be, inter alia, polishing. However, since the liquid makes these irregularities invisible, this step can be omitted.

However, the invention is not limited thereto. The outer surface of the display window can be formed by a film, for example an antireflection film or filter on the display window. This may be the case, for example, if the holder is mounted on an existing cathode my tube which is provided with such a film or filter.

For the liquids, use can be made of, inter alia, ethylene glycol or water. The display window is generally made of glass having a refractive index of approximately 1.52. Ethylene glycol has a refractive index of approximately 1.45, water has a refractive index of approximately 1.33. To reduce reflection, ethylene glycol is more suitable than water. Water, however, is better than ethylene glycol if possible harmful effects to the environment are taken into consideration. The side walls of the holder may consist of metal, synthetic resin or another material.

The holder can be provided at any time and/or the liquid can be supplied or drained at any time. In this example, the holder has a separate inlet and outlet. They may be one and the same, as in the case of a bottle. If desired, the liquid may even be introduced into the holder by a customer at home or at work. Thus, by virtue of the invention the liquid can be manufactured and used in a very flexible manner. In addition, it is ecologically sound because at the end of the life cycle of the tube the liquid can be drained and reused or processed.

The liquid may be coloured, so that it acts as a colour filter. In an embodiment, the liquid is electrically conductive to preclude that the plate becomes charged. The plate may consist of glass or a synthetic resin. In order to increase the contrast, the plate may have a transmission coefficient of less than 100%, for example approximately 50%.

In addition to the above-described effects, the invention has the further advantage, notably if the plate is flat (flat is to be understood to mean in this connection that the plate has a radius of curvature which is much greater (more than 10 times) than the radius of curvature of the inner surface of the display window), that the image displayed appears to be much flatter than the image displayed by a display device without a holder, and that reflections at the plate are hardly disturbing. The apparent curvature of the image displayed is reduced by approximately 30%. If the radius of curvature of the inner surface and the outer surface of the display window is for example 1.5 meters and the liquid has a refractive index of approximately 1.5 and the plate is flat, then the apparent radius of curvature of the image displayed is approximately 1.5 meters if no use is made of the invention, whereas the apparent radius of curvature is at least 2.25 meters if use is made of the invention. This will be explained in greater detail with reference to FIGS. **6*a* and 6*b*** and Table 1. The term "radius of curvature" is to be understood to mean herein the average of the radii of curvature along the short and the long axes and the diagonal of the inner surface of the display window. Therefore, the image seems to be much flatter. In embodiments, the plate may be slightly curved, preferably toward the display window, or flat. A further advantage is obtained if the side walls of the holder are opaque. This results in an improved contrast. Much less ambient light (in comparison with an embodiment in which no holder having opaque side walls is used) can reflect at the screen, which results in an improved contrast. A further advantage is that, unlike the outer surface of the display window, the plate does not become, or hardly becomes, electrically charged, so that the deposition of dust on the plate is precluded and an improved contrast is obtained.

FIGS. 2*a* and 2*b* are a detailed side view and front view, respectively, of a display device having a holder. The holder is secured to an implosion-protection band 20 having means 21 for suspending the cathode ray tube in an envelope, for example by means of an adhesive, cement or a weld. The holder comprising four side walls 22 and a plate 23. The side walls are opaque and form, in combination with the anti-implosion clamping band 21 and the plate 23, a sealed, liquid-tight space 24. A side wall is provided with an inlet 25 and an outlet 26. Liquid 27 is introduced via the inlet. To transport the display device, the liquid can be removed from the holder via the outlet. This reduces the risk of leakage. In this example, the space 24 is completely filled with liquid 27. There are embodiments in which a small part of the space is not filled with liquid. This has the advantage that the liquid can expand without exerting large forces on the holder for the plate if the temperature increases. Alternatively, a part of the holder can be made of flexible material or can be constructed as a bellows. Such constructions can take up the expansion of the liquid.

FIG. 3 shows a further embodiment of a cathode ray tube in accordance with the invention. The cathode ray tube comprises an anti-implosion clamping band 31. The clamping band is extended in the x-direction. The plate 32 is secured to the side walls of the clamping band. The extended clamping band has an inlet for liquid.

FIGS. 4*a*, 4*b* and 4*c* are cross-sectional views of a detail of a number of embodiments. In FIG. 4*a* the plate 41 is attached to a flange 42 of a holder 43 by means of an adhesive. In FIG. 4*b* the flange is bent. Between the flange 42 and the plate 41 there is a cemented or glued joint 44. From the point of view of safety, the latter construction is better than the former. In FIG. 4*c* the flange is provided with a flexible, for example rubber, ridge or ring 45. The holder also comprises clamping devices 46 which press the face plate onto the ridge or ring. In this manner the space in which the liquid is contained is sealed. FIG. 4*c* also shows that the plate is opaque at the edge, which is brought about in this example by an opaque layer 47. This opaque edge increases the contrast of the image displayed. Furthermore, the inside of the holder is preferably blackened. This leads to a further increase of the contrast.

FIGS. 5*a*, 5*b*, 5*c*, 5*d* and 5*e* show a detail of an embodiment of the display device in accordance with the invention. In FIG. 5*a*, the holder 43 is secured to the implosion-protection band 20 by means of a cemented joint 53. A cement 54, for example a silicone cement, is provided between the implosion-protection band and the edge of the display window to seal the space which holds the liquid. In FIG. 5*b*, a flexible resilient ring 55 is provided inside the holder. This ring presses against the edge of the display window, so that a liquid-tight seal is obtained. FIG. 5*b* further shows a holder having a bent flange 56. This flange is flexible and acts somewhat like a bellows. In FIG. 5*c*, a flexible edge or ring 57 is provided along the edge of the display window. A holder 58 is pressed over the flexible edge or ring. By virtue of this flexible, for example rubber, edge 57 a liquid-tight seal is obtained. In FIG. 5*c*, the flange of the holder is bent inwards. The plate 59, fixed to the holder 58, such as by a cement or glue, for example, is slightly curved toward the display window. In FIG. 5*d*, the holder itself is made of a flexible material and is pressed onto the display window. In this example, the plate 62 has edges 63. Within the framework of the invention, "flat" plate is to be understood to mean that the part of the plate in front of the display window is at least substantially flat. By means of a nut and screw connection the edges are clamped against the holder. In this example, a flexible ring 65 is located between the holder and the edge. This is a simple and reversible manner of securing the plate to the holder. In general, the holder may be made of various materials, for example metal or synthetic resin. Preferably, the edge of the holder is made of a magnetizable material, for example iron. By virtue thereof, the tube is partly protected against disturbing electro-magnetic radiation. In all of the above examples, the holder can be regarded as forming a part of or being connected to the cathode ray tube. However, the holder can form part of the housing of the cathode ray tube. Such a construction is shown in FIG. 5*e*. The cathode ray tube 71 is suspended in a housing 72 and is pressed against the edge 73. This edge is made of flexible material. The housing also has a front side 74 on which a, for example flat, plate is secured. A sealing means, for example a rubber ring 75, is located between the plate and the front side of the housing. The intermediate space is filled with liquid 76.

In an alternative embodiment of the invention the holder contains a gel instead of a liquid. In comparison with a solid substance, a gel and a liquid have some of the above-mentioned advantages in common. A gel, like a liquid, follows the outside of the display window and, in general, does not dry out. Also the above-mentioned optical advantages are approximately equal. The disadvantage of a gel in comparison with a liquid is, however, that on filling the space there is a relatively great risk that bubbles will form in the gel. Such bubbles are visible. A usable gel is, for example, Sylguard 527 by Dow Corning. A gel is not a hard solid substance and hence can relatively easily be removed from the holder. For example, it can be subjected to a gas pressure via the inlet, causing the gel to be urged out via the outlet. In this manner the great majority of the gel is removed, which may be sufficient to enable the cathode ray tube to be processed at the end of its life cycle. However, complete removal of the gel from the holder remains difficult. For this reason, preferably a gel is used which liquefies at a temperature below 160° C. or which can be dissolved in a solvent. In this case the gel can readily be removed from the holder, if necessary. In general, a cathode ray tube can be heated to approximately 160° C. without there being a substantial increase of the implosion risk. At temperatures in excess of approximately 200° C. there is a risk of implosion.

The advantage of a gel over a liquid is that, in case of a leak in the holder, the gel flows out less easily than a liquid. Preferably, a gel is used which liquefies at a temperature in excess of 80° C. Under extreme conditions the temperature of the cathode ray tube may rise to 80° C. If the temperature at which the gel liquefies is higher than 80° C., the risk of leakage, for example during transport, is small.

It will be obvious that within the scope of the invention many variations are possible to those skilled in the art.

It is noted that within the framework of the invention, the terms "liquid" and "gel" are to be understood to mean substances which, under normal conditions, remain a liquid and a gel, respectively. They are not to be understood to mean substances which, after they have been introduced in the space between the plate and the display window in the form of a liquid or a gel, harden to form a solid substance, such as certain types of adhesives. From the foregoing it follows that such substances are unsuitable to solve the problems posed herein.

The invention is important for, in particular, monitor devices. In such devices the distance between the viewer and the display device is small (approximately 50 cm). Consequently, imperfections on the display window are very perceptible. The impression that the radius of curvature of the image displayed is increased in a display device in accordance with the invention is strongest for relatively small distances between the viewer and the display window. FIGS. 6a and 6b show the position of a viewer 81 relative to the display window 82 of a display device. The inner surface of the display window is provided with a luminescent screen 83. This inner surface is curved and has a radius of curvature R. The outer surface is also curved and has approximately the same radius of curvature. In this example, one radius of curvature is shown, the curvature and hence the radius of curvature may vary across the inner surface. The viewer is at a distance D from the outer surface of the display window (FIG. 6a) or from the outer surface of plate 84 (FIG. 6b). FIG. 6a shows a display window without a holder, FIG. 6b shows a display window with a holder. The thickness of the display window in the center of the display window is $d_1$, the thickness of the liquid or gel in the center of the display window is $d_2$ and the thickness of the plate 64 is $d_3$. The viewer sees the luminescent screen through the display window (FIG. 6a) or through the assembly of holder and display window (FIG. 6b). To the viewer who is looking at the luminescent screen, it seems that the screen is present on the curved plane indicated by dotted lines 85. For this plane, a radius of curvature R' may alternatively be defined.

Table 1 lists a number of data for two display devices, i.e. the diagonal D (in inches), the radius of curvature R of the inner surface of the cathode ray tube (in mm), the thickness $d_1$ (in mm) of the display window, the thickness $d_2$ (in mm) of the layer of liquid or gel in the center of the display window, the thickness $d_3$ (in mm) of the plate, the distance X (in mm) between the viewer and the display window and the apparent radius of curvature R' (in mm) of the image displayed. These data are based on the assumption that the refractive indices of the display window, liquid and plate are 1.52 and that X is the average customary distance between a viewer and a television receiver (example 1) and between a viewer and a computer monitor (example 2). Example 3 is a television receiver (3a) or a computer monitor (3b) without a holder in accordance with the invention.

| Example | D | R | $d_1$ | $d_2$ | $d_3$ | X | R' |
|---|---|---|---|---|---|---|---|
| 1 | 14" | 550 | 15 | 5 | 5 | 2000 | 841 |
| 2 | 14" | 550 | 15 | 5 | 5 | 600 | 894 |
| 3a | 14" | 550 | 15 | — | — | 2000 | 550 |
| 3b | 14" | 550 | 15 | — | — | 600 | 550 |

From the Table it follows that, by virtue of the invention, the image displayed has a much flatter appearance (the radius of curvature is approximately a factor of 1.5 larger), particularly for monitors (example 2). If the refractive index of the substance in the space between the display window and the plate is higher than the refractive index of the display window and/or the plate, the radius of curvature seems to be even larger. This is a preferred embodiment.

The latter effect, i.e. that in the case of monitors the radius of curvature appears to be larger and hence the displayed image smaller than in the case of television receivers, is an optical effect which is brought about by the presence of a substance (for example a liquid or a gel) between the substantially flat plate and the display window, which substance has a refractive index which is substantially equal to the refractive indices of the display window and the plate and by the fact that the plate is flat or substantially flat. Monitors are often used in a desk-top configuration comprising a monitor, a computer and a keyboard. The distance between the operator of the keyboard and the display window is typically 60 cm. In the case of television receivers the average distance between the viewer and the display window is much greater, approximately 2 to 3 meters. As listed in Table 1, the apparent curvature of the image displayed is also governed by the distance between the viewer and the display window.

It will be obvious that within the scope of the invention many variations are possible. For example, in the above examples the holder has an inlet and an outlet (if necessary, the inlet may also serve as an outlet). This does not limit the scope of the invention. After introducing the liquid or gel through an inlet, the inlet may be sealed to preclude leaking.

We claim:

1. A direct-vision display device comprising a cathode ray tube having a display window, wherein the improvement comprises a holder comprising a transparent plate arranged in front of the display window, and a transparent liquid in the space between the display window and the plate, said transparent liquid having a refractive index which differs maximally 0.25 from refractive indices of the display window and the plate.

2. A display device as claimed in claim 1, in which the cathode ray tube comprises an implosion-protection band around the display window, characterized in that the holder is secured to the implosion-protection band.

3. A display device as claimed in claim 2, characterized in that side walls of the holder are opaque.

4. A display device as claimed in claim 1, in which the cathode ray tube comprises an implosion-protection band around the display window, characterized in that said implosion-protection band, viewed in a direction transversely to the display window, is extended in the direction of the plate in such a manner that a part of the implosion-protection band forms part of the holder.

5. A display device as claimed in claim 4, characterized in that side walls of the holder are opaque.

6. A display device as claimed in claim 1, characterized in that the transparent plate is flat.

7. A display device as claimed in claim 1, characterized in that the differences in refractive index are smaller than 0.1.

8. A display device as claimed in claim 1, comprising a housing for the cathode ray tube, characterized in that the holder is at least partially formed by the housing.

9. A display device as claimed in claim 1, characterized in that the display device is a monitor.

10. A direct-vision display device comprising a cathode ray tube having display window, wherein the improvement comprises a holder comprising a transparent plate arranged in front of the display window, and a gel in the space between the display window and the plate, said gel having a refractive index which differs maximally 0.25 from the refractive indices of the display window and the plate.

11. A display device as claimed in claim 10, in which the cathode ray tube comprises an implosion-protection band around the display window, characterized in that the holder is secured to the implosion-protection band.

12. A display device as claimed in claim 11, characterized in that side walls of the holder are opaque.

13. A display device as claimed in claim 10, in which the cathode ray tube comprises an implosion-protection band around the display window, characterized in that said implosion-protection band, viewed in a direction transversely to the display window, is extended in the direction of the plate in such a manner that a part of the implosion-protection band forms part of the holder.

14. A display device as claimed in claim 13, characterized in that side walls of the holder are opaque.

15. A display device as claimed in claim 10, characterized in that the transparent plate is flat.

16. A display device as claimed in claim 10, characterized in that the differences in refractive index are smaller than 0.1.

17. A display device as claimed in claim 10, comprising a housing for the cathode ray tube, characterized in that the holder is at least partially formed by the housing.

18. A display device as claimed in claim 10, characterized in that the display device is a monitor.

19. A direct-vision display device comprising a cathode ray tube having a display window, wherein the improvement comprises a holder comprising a transparent plate arranged in front of the display window in such a manner that there is a space between the display window and the plate, and said holder comprising an inlet and an outlet for supplying liquid to the space and draining it from the space.

20. A display device as claimed in claim 19, in which the cathode ray tube comprises an implosion-protection band around the display window, characterized in that the holder is secured to the implosion-protection band.

21. A display device as claimed in claim 19, in which the cathode ray tube comprises an implosion-protection band around the display window, characterized in that said implosion-protection band, viewed in a direction transversely to the display window, is extended in the direction of the plate, in such a manner that a part of the implosion-protection band forms part of the holder.

22. A display device as claimed in claim 20, characterized in that side walls of the holder are opaque.

23. A display device as claimed in claim 22, characterized in that the transparent plate is flat.

24. A display device as claimed in claim 19, comprising a housing for the cathode ray tube, characterized in that the holder is at least partially formed by the housing.

25. A display device as claimed in claim 19, characterized in that the display device is a monitor.

26. A display device as claimed in claim 21, characterized in that side walls of the holder are opaque.

27. A display device as claimed in claim 19, characterized in that the transparent plate is flat.

28. A direct-vision display device comprising a cathode ray tube having a display window, wherein the improvement comprises a holder comprising a transparent plate arranged in front of the display window, and a transparent substance in the space between the display window and the plate, said transparent substance having a refractive index which differs maximally 0.25 from the refractive indices of the display window and the plate, and said plate being at least substantially flat, said cathode ray tube being a monitor.

* * * * *